US005342661A

United States Patent [19]

Wilcox, II

[11] Patent Number: 5,342,661

[45] Date of Patent: Aug. 30, 1994

[54] FOLDING ARTIFICIAL CHRISTMAS TREE

[76] Inventor: Donald R. Wilcox, II, Box 722, Clendenin, W. Va. 25045

[21] Appl. No.: 915,328

[22] Filed: Jul. 20, 1992

[51] Int. Cl.[5] ..... A47G 33/06

[52] U.S. Cl. ..... 428/18; 211/196

[58] Field of Search ..... 156/61; 211/196, 205; 222/179, 402.15, 192; 428/18, 19, 20; D11/118

[56] References Cited

U.S. PATENT DOCUMENTS

| | | | |
|---|---|---|---|
| 3,674,612 | 7/1972 | Gehl, Jr. | 428/7 |
| 3,846,213 | 11/1974 | Thiemann | 428/9 |
| 3,979,786 | 9/1976 | Vierra et al. | 222/192 X |
| 4,093,758 | 6/1978 | Weskamp et al. | 428/8 |
| 4,140,823 | 2/1979 | Weskamp | 428/9 |
| 4,496,615 | 1/1985 | Huang | 211/196 X |
| 4,897,292 | 1/1990 | Glickman | 428/8 |

*Primary Examiner*—Henry F. Epstein
*Attorney, Agent, or Firm*—E. Michael Combs

[57] ABSTRACT

A base and at least one extension tube are arranged for coaxially aligned relationship relative to one another mounted to an underlying support stand. The apparatus includes a plurality of branch rods, each having a matrix of branch rod bristles, with each branch rod mounted relative to a single bracket of a plurality of mating brackets to position the branch rods at acute angles relative to the base and extension tubes. Optional apparatus of the invention includes a scent dispenser structure directing scent through the base and extension tube directed through mesh webs within the tubes.

5 Claims, 4 Drawing Sheets

FOLDING ARTIFICIAL CHRISTMAS TREE

BACKGROUND OF THE INVENTION

1. Field of the Invention

The field of invention relates to Christmas tree structure, and more particularly pertains to a new and improved folding Christmas tree apparatus wherein the same is arranged for the erection of a simulation Christmas tree.

2. Description of the Prior Art

Various artificial Christmas tree structure has been utilized in the prior art and exemplified by the U.S. Pat. Nos. 4,140,823; 4,093,758; 3,846,213; 3,674,612; and 4,897,292.

The prior art structure has heretofore failed to address a means of ease of assemblage and durability from a compact structure set forth by the instant invention and in this respect, the present invention substantially fulfills this need.

SUMMARY OF THE INVENTION

In view of the foregoing disadvantages inherent in the known types of Christmas tree apparatus now present in the prior art, the present invention provides a folding Christmas tree apparatus wherein the same utilizes branch members foldably mounted relative to a support tube structure to permit ease of mounting and assemblage of the Christmas tree structure. As such, the general purpose of the present invention, which will be described subsequently in greater detail, is to provide a new and improved folding Christmas tree apparatus which has all the advantages of the prior art Christmas tree apparatus and none of the disadvantages.

To attain this, the present invention provides a base and at least one extension tube arranged for coaxially aligned relationship relative to one another mounted to an underlying support stand. The apparatus includes a plurality of branch rods, each having a matrix of branch rod bristles, with each branch rod mounted relative to a single bracket of a plurality of mating brackets to position the branch rods at acute angles relative to the base and extension tubes. Optional apparatus of the invention includes a scent dispenser structure directing scent through the base and extension tube directed through mesh webs within the tubes.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved folding Christmas tree apparatus which has all the advantages of the prior art Christmas tree apparatus and none of the disadvantages.

It is another object of the present invention to provide a new and improved folding Christmas tree apparatus which may be easily and efficiently manufactured and marketed.

It is a further object of the present invention to provide a new and improved folding Christmas tree apparatus which is of a durable and reliable construction.

An even further object of the present invention is to provide a new and improved folding Christmas tree apparatus which is susceptible of a low cost of manufacture with regard to both materials and labor, and which accordingly is then susceptible of low prices of sale to the consuming public, thereby making such folding Christmas tree apparatus economically available to the buying public.

Still yet another object of the present invention is to provide a new and improved folding Christmas tree apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
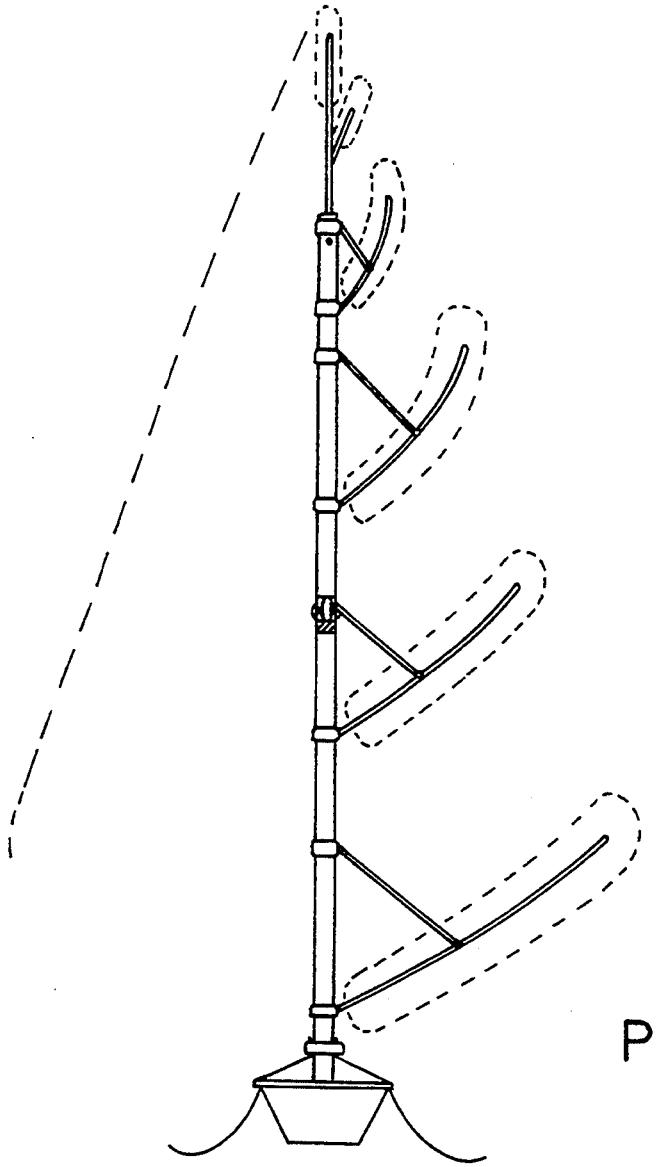
FIG. 1 PRIOR ART
FIG. 1 is an orthographic view of a prior art folding Christmas tree structure, as set forth in the U.S. Pat. No. 3,846,213.
Figure 2:
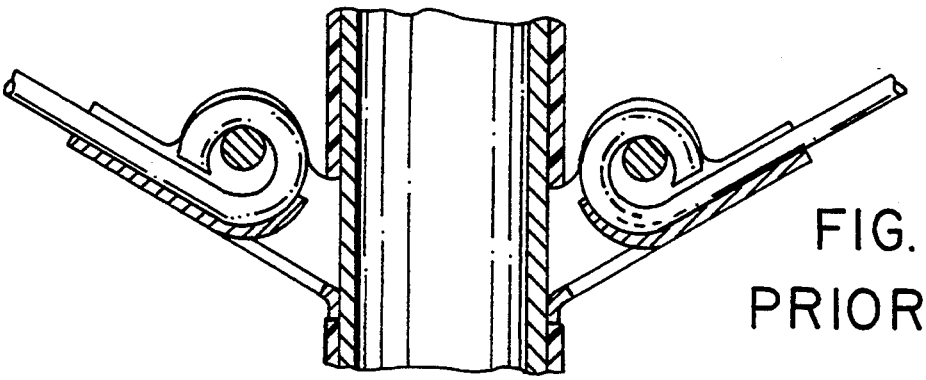
FIG. 2 PRIOR ART
FIG. 2 is an orthographic cross-sectional illustration of a folding Christmas tree structure having pivotal branches, as indicated in U.S. Pat. No. 4,140,823.

With reference now to the drawings, and in particular to FIGS. 1 to 6 thereof, a new and improved folding Christmas tree apparatus embodying the principles and concepts of the present invention and generally designated by the reference numeral 10 will be described.

More specifically, the folding Christmas tree apparatus 10 of the instant invention essentially comprises a base tube 11 arranged for receiving slidably at its upper end an extension tube 12, wherein the base tube and extension tube are arranged for coaxial alignment relative to one another permitting separation relative to one another during periods of non-use and storage. The base tube 11 has its lower end received within a support stand 13, having a support collar 14, with a plurality of leg members 15 canted exteriorly and downwardly relative to the collar 14. A row of base tube apertures 16 is arranged parallel to the axis of the base tube 11 to receive a first lock pin 17 through one of the base tube apertures 16 above the collar 14 to position the base tube relative to the support stand 13. The extension tube includes a row of extension tube apertures 18 oriented parallel to an axis of the extension tube, wherein a second lock pin 19 positioned in one of the extension tube apertures 18 above an upper end of the base tube positions the extension tube relative to the base tube. An extension tube upper end opening 20 is arranged for receiving a central rod 21 having a matrix of central rod bristles 22 extending exteriorly therefrom, wherein the central rod 21 is arranged coaxially aligned relative to the base tube 11 and extension 12 when in an assembly configuration.

Figure 3:
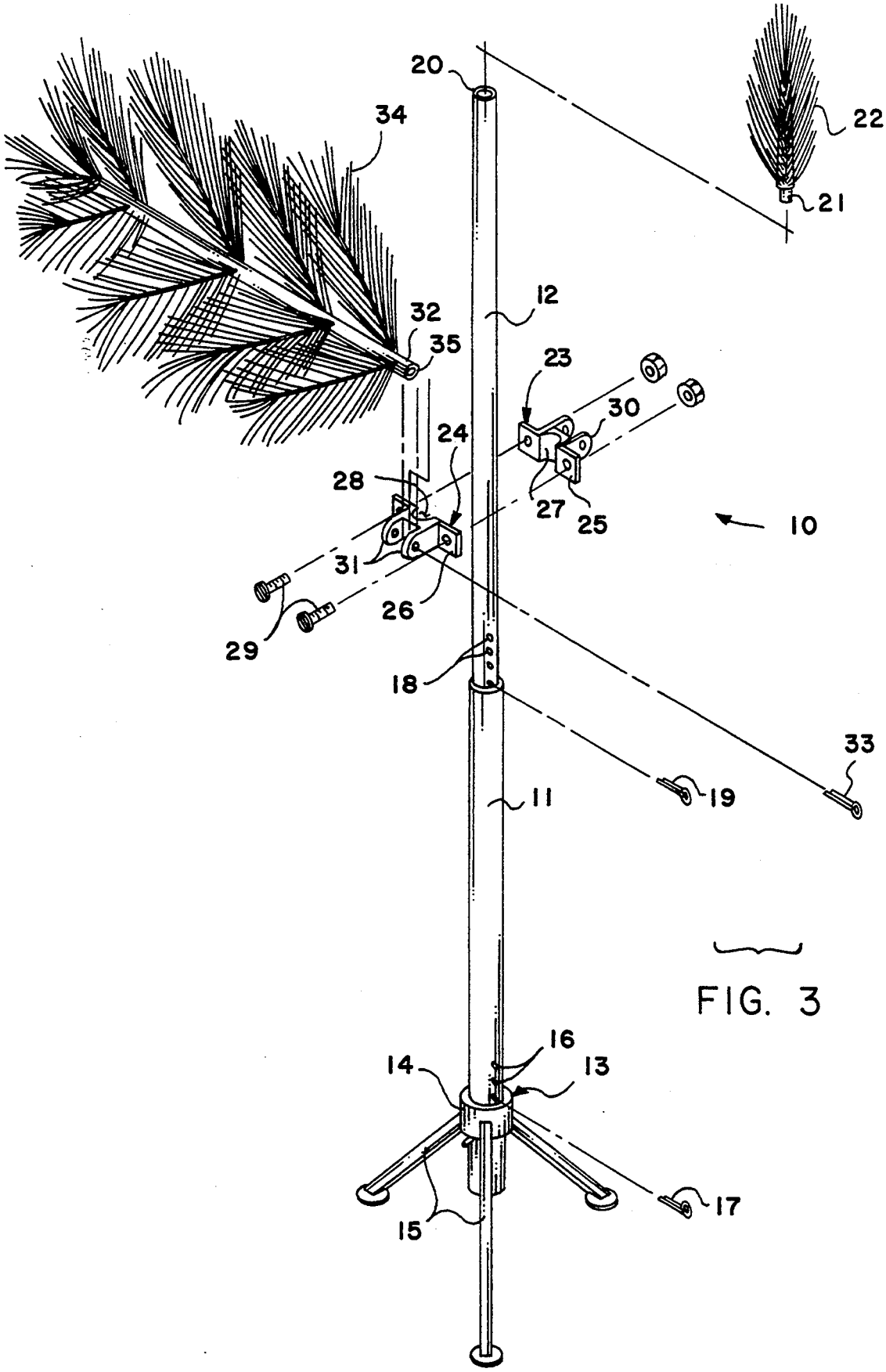
FIG. 3 is an isometric partial exploded illustration of the invention.

A plurality of branch rods 32 are mounted about the base extension tubes 11 and 12 projecting radially and canted upwardly relative to the base extension tubes. To this end, first and second bracket members 23 and 24 defining a bracket assembly are arranged, wherein the first and second bracket members 23 and 24 are configured in a mirror image orientation relative to one another on opposed sides when mounted to the base and extension tubes 11 and 12. For purposes of illustration, only one such bracket structure is illustrated in FIG. 3, where it is understood that one such bracket assembly utilizing the first and second bracket members 23 and 24 is employed for each branch rod 32.

The first bracket member 23 includes a first mounting flange 25 having a first semi-cylindrical cavity 27 cooperating with a second semi-cylindrical cavity 28 directed into the second mounting flange 26 of the second mounting bracket 24, wherein the first and second semi-cylindrical cavities 27 and 28 are arranged to receive the base and extension tubes when selectively positioned thereabout. Fasteners 29 orthogonally directed through the first and second mounting flanges 25 and 26 secure the first and second bracket members 23 and 24 together. The first and second bracket members 23 and 24 include respective first and second bracket parallel flanges 30 and 31, wherein each of the parallel flanges 30 and 31 defining a pair of such flanges receives a lower end portion of the branch rod 32, wherein a branch rod axle 33 directed through the flanges is directed through the branch rod 32 adjacent its lowermost end 35. The lowermost end 35 is typically oriented at an oblique angle relative to the branch rod to cant the branch rod upwardly relative to the extension or base tube it is to be mounted relative to. The branch rod bristles 34 project in surrounding relationship relative to the branch rod.

Figure 4:
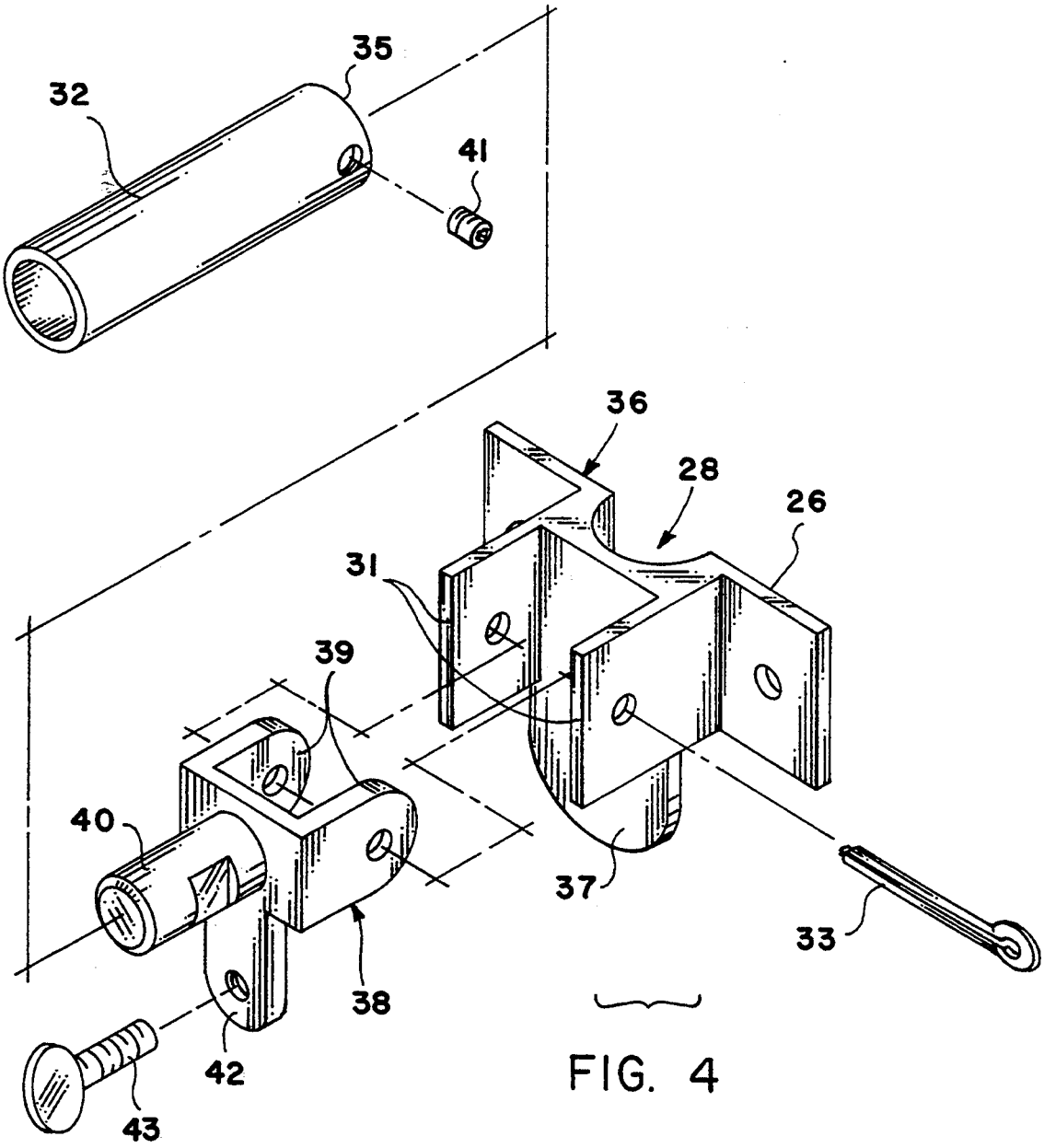
FIG. 4 is an isometric illustration of a modified bracket structure utilized by the invention.

The FIG. 4 illustrates a modified bracket member 36 to replace each of the first and second bracket members 23 and 24, with the modified bracket member 36, in addition to the structure as noted above, includes an abutment flange 37 oriented between the associated pair of parallel flanges 31 and projects therebelow in an orthogonal relationship relative to the flanges 31. A mounting bracket 38 in turn is secured between the parallel flanges 31 and is formed with mounting bracket parallel flanges 39, wherein the branch rod axle 33 is directed through the parallel flanges 31 and the mounting bracket flanges 39 to secure the brackets together. A mounting bracket boss 40 projecting rearwardly and fixedly to the parallel flanges 39 is arranged to receive the tubular branch rod 32, as indicated in FIG. 4, with a lock fastener 41 directed through the branch rod adjacent its lowermost end 35 for engagement with the boss 40. An adjustment flange 42 projecting orthogonally and below the boss 40 includes an externally threaded adjustment rod 43 threadedly directed through the adjustment flange 42 below the boss 40 for abutment and engagement with the abutment flange 37, whereupon selective rotation of the adjustment rod 43 relative to the adjustment flange 42 effects selective pivotment of the mounting bracket 38 about the branch rod axle 33.

Figure 5:
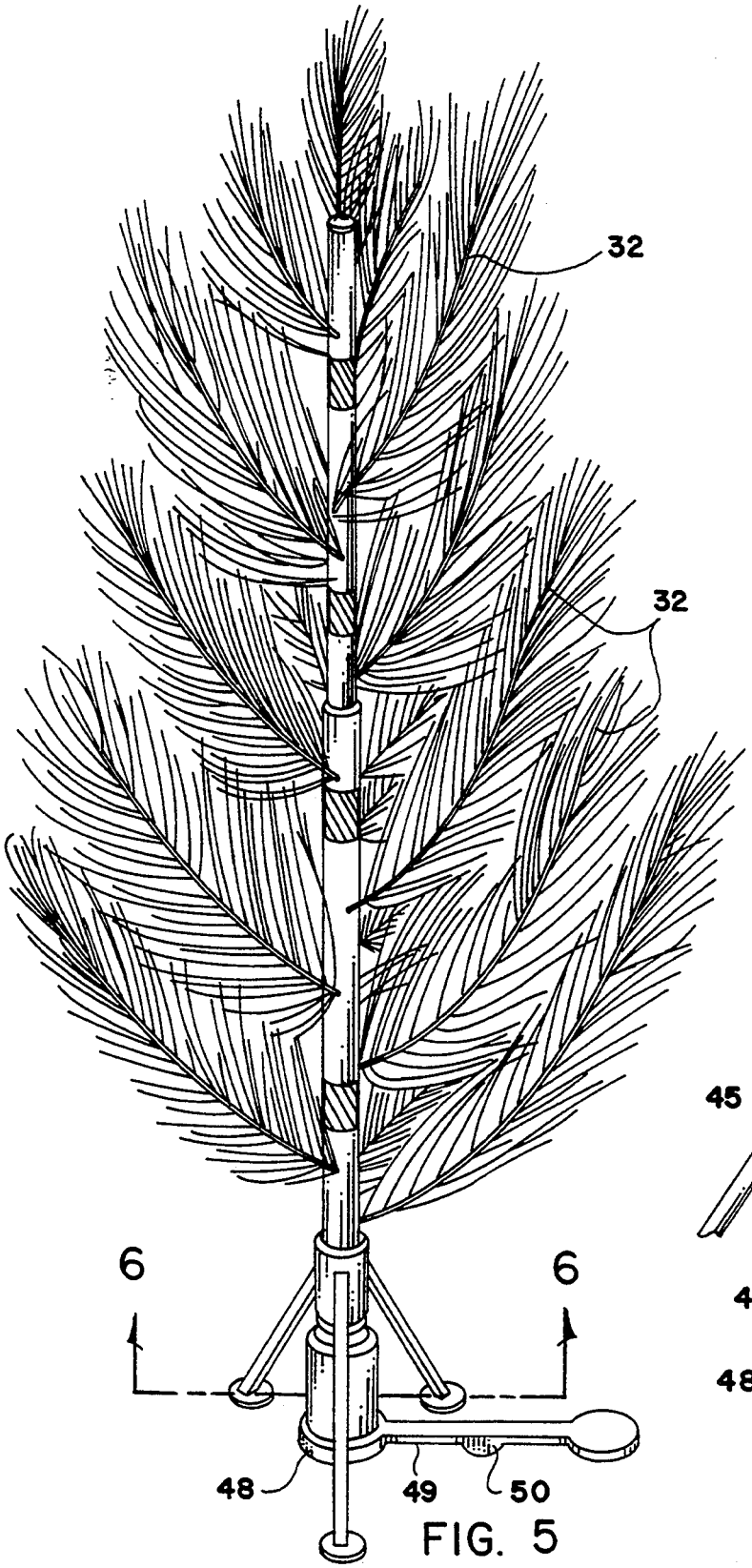
FIG. 5 is an isometric illustration of the Christmas tree in an assembled configuration.
Figure 6:
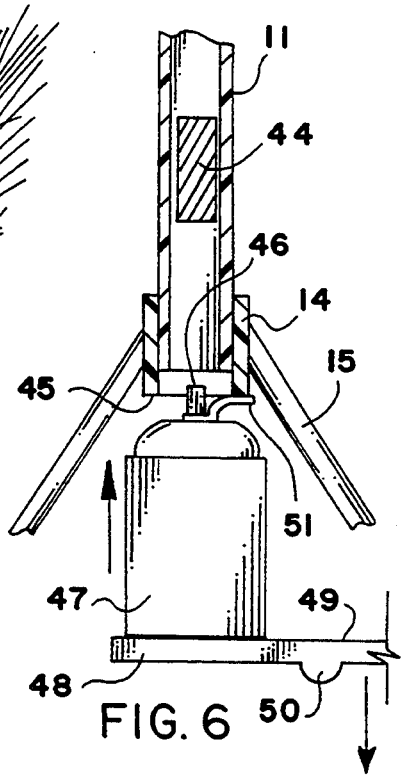
FIG. 6 is an orthographic view, taken along the lines 6—6 of FIG. 5 in the direction indicated by the arrows.

The FIGS. 5 and. 6 illustrates a modified base extension tube structure, wherein the collar 14 is formed with a collar lower edge 45 positioned above an aerosol container 47. Venting mesh webs 44 are mounted at a plurality of locations through the base and extension tube 11 and 12, wherein the aerosol container 46 includes an aerosol nozzle 46 directed upwardly into the base extension tubes to direct aerosol therewithin for projection of the aerosol exteriorly of the base and extension tubes for simulating realism in the organization by utilizing pine scent and the like. A container trigger lever 51 in engagement with the collar lower edge 45 effects release of aerosol spray from within the container 47 to direct such spray under pressure into the base and extension tube 11 and 12 respectively for projection through the webs 44. A support plate 48 positioned below and receiving the aerosol container thereon includes a support plate 49 lever 49 having a fulcrum projection 50 medially thereof, whereupon tilting of the support plate 48 about the fulcrum projection 50 projects the trigger lever 51 into engagement with the collar lower edge 45 to project aerosol spray into the base and extension tubes 11 and 12.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A folding artificial Christmas tree, comprising, a base tube and an extension tube, the base tube having a base tube lower end and a base tube upper end, the extension tube including an extension tube lower end and an extension tube upper end, with the base tube upper end slidably receiving the extension tube lower end therewithin in a coaxially aligned relationship, and a support stand, the support stand having a cylindrical collar, and the cylindrical collar including a plurality of leg members extending downwardly relative to the cylindrical collar and projecting exteriorly of the cylindrical collar, and the base tube lower end received within the cylindrical collar, and the extension tube upper end having an upper end opening and a central rod, the central rod mounted in the upper end opening and being coaxially aligned with the base tube and the extension tube, with the central rod having a matrix of central rod bristles mounted coextensively thereabout, and a plurality of bracket pairs, with at least one bracket pair mounted about the base tube, and at least one bracket pair mounted about the extension tube, wherein each bracket pair includes a first bracket member and a second bracket member, and a plurality of branch rods, with one branch rod of said plurality of branch rods pivotally mounted to each said first bracket member and said second bracket member, and the first bracket member and the second bracket member are oriented in a mirror image configuration relative to one another, and the base tube includes a row of base tube apertures and a first lock pin directed through one of said base tube apertures above the support collar, and the extension tube includes a row of extension tube apertures oriented parallel to the base tube apertures, and a second lock pin directed through one of said extension tube apertures above the base tube to position the extension tube relative to the base tube.

2. An artifical Christmas tree as set forth in claim 1 wherein each bracket member includes a mounting flange, and the mounting flange including a semi-cylindrical cavity medially thereof, and a plurality of parallel bracket flanges projecting beyond the mounting flange, and a mounting bracket pivotally mounted to the mounting flanges, wherein the mounting bracket includes a plurality of mounting bracket flanges received between the bracket flanges and a pivot axle directed through the bracket flanges and the mounting flanges to pivotally mount the mounting flanges relative to the bracket flanges, and the mounting bracket further includes a bracket boss orthogonally oriented relative to the bracket flanges extending exteriorly of the bracket flanges beyond the bracket flanges, with each said branch rod having a tubular configuration, with the branch rod received on said bracket boss.

3. An artificial Christmas tree as set forth in claim 2 wherein branch rod includes a branch rod lowermost end and a lock fastener directed through the branch rod adjacent the lowermost end in abutment with the boss.

4. An artificial Christmas tree as set forth in claim 3 wherein the bracket flanges include an abutment flange projecting below the bracket flanges, and the mounting flanges include an adjustment flange oriented below the mounting flanges, and an adjustment rod threadedly directed through the adjustment flange in abutment with the abutment flange to effect pivotment of the mounting bracket relative to the bracket member upon projection of the adjustment rod through the adjustment flange.

5. An artificial Christmas tree as set forth in claim 4 wherein the base tube and extension tube each include a plurality of venting mesh webs directed through the base tube and the extension tube, and the collar includes a collar lower edge, and an aerosol container positioned below the collar lower edge coaxially aligned with the base tube, and the aerosol container including an aerosol container nozzle directed into the base tube to project aerosol spray through the mesh webs, and a trigger lever mounted to the aerosol container in abutment with the collar lower edge, and a support plate mounted below the aerosol container receiving the aerosol container thereon, the support plate including a support plate lever extending laterally of the support plate integrally mounted thereto, and the support plate lever including a fulcrum projection mounted to the support plate lever to effect pivotment of the support plate lever about the fulcrum projection.

* * * * *